United States Patent [19]

Bolduc

[11] Patent Number: 5,052,585

[45] **Date of Patent: * Oct. 1, 1991**

[54] DISPENSER

[76] Inventor: Lee R. Bolduc, 6416 Gainsborough Dr., Raleigh, N.C. 27612

[ * ] Notice: The portion of the term of this patent subsequent to Jul. 17, 2007 has been disclaimed.

[21] Appl. No.: 552,884

[22] Filed: Jul. 16, 1990

Related U.S. Application Data

[63] Continuation-in-part of Ser. No. 261,320, Oct. 24, 1988, Pat. No. 4,979,638, and a continuation-in-part of Ser. No. 251,806, Oct. 3, 1988, Pat. No. 4,941,615, said Ser. No. 261,320, is a continuation-in-part of Ser. No. 49,361, May 14, 1987, which is a continuation of Ser. No. 812,237, Dec. 23, 1985, abandoned.

[51] Int. Cl.[5] ..... B67D 5/60; A62C 35/88

[52] U.S. Cl. ..... 222/1; 222/87; 222/145; 239/309

[58] Field of Search ..... 222/82, 145, 154, 81, 222/80, 1, 87; 239/309, 272; 169/83

[56] References Cited

U.S. PATENT DOCUMENTS

| | | | |
|---|---|---|---|
| 315,610 | 4/1885 | Gee . | |
| 518,258 | 4/1894 | Lechartier | 169/83 |
| 1,536,144 | 5/1925 | Robinson | 169/83 |
| 1,587,598 | 6/1926 | Magg . | |
| 1,779,959 | 10/1930 | Bellocchio . | |
| 2,167,866 | 8/1939 | Bennett | 222/82 |
| 2,716,637 | 8/1955 | Bunting . | |
| 2,921,720 | 1/1960 | Malachick | 222/154 |
| 2,930,384 | 3/1960 | Strain et al. . | |
| 3,080,094 | 3/1963 | Modderno . | |
| 3,236,418 | 2/1966 | Dalle et al. . | |
| 3,240,403 | 3/1966 | Modderno . | |
| 3,255,924 | 6/1966 | Modderno . | |
| 3,349,966 | 10/1967 | Schwartzman . | |
| 3,416,707 | 12/1968 | Pollard . | |
| 3,416,709 | 12/1968 | Shultz et al. . | |
| 3,491,916 | 1/1970 | Graham . | |
| 3,591,089 | 7/1971 | Cronan | 239/304 |
| 3,638,786 | 2/1972 | Borecki et al. | 206/47 A |
| 3,648,899 | 3/1972 | Lukesch et al. | 222/82 |
| 3,658,719 | 4/1972 | McConnaughey . | |
| 3,679,102 | 7/1972 | Charle et al. | 222/192 |
| 3,718,235 | 2/1973 | Cronan . | |
| 3,773,264 | 11/1973 | Cronan | 239/304 |
| 3,791,980 | 2/1974 | Goldsmith . | |
| 3,966,087 | 6/1976 | Curry et al. . | |
| 4,121,772 | 10/1978 | Cronan | 239/304 |
| 4,201,316 | 5/1980 | Klingaman | 222/80 |
| 4,387,998 | 6/1983 | Szigeti | 366/130 |
| 4,465,183 | 8/1984 | Saito et al. | 206/222 |
| 4,491,250 | 1/1985 | Liebermann | 222/386.5 |
| 4,613,061 | 9/1986 | Meuresch et al. | 222/82 |
| 4,682,689 | 7/1987 | Pereira et al. | 206/222 |
| 4,779,763 | 10/1988 | Klawitter . | |

FOREIGN PATENT DOCUMENTS

| | | |
|---|---|---|
| 1168772 | 12/1958 | France . |
| 215493 | 5/1924 | United Kingdom . |

OTHER PUBLICATIONS

Aerosol Age, Sep. 1985; Apr. 1986.

*Primary Examiner*—Andres Kashnikow
*Assistant Examiner*—Kevin Weldon
*Attorney, Agent, or Firm*—Burd, Bartz & Gutenkauf

[57] ABSTRACT

A dispenser having a transparent container for storing a propellant and a first compound under pressure. A normally closed valve is mounted on top of the container to control the dispensing of the materials from the container. An ampule containing a second material separate from the first material until the ampule is broken is positioned generally longitudinally of the length of the container with a sleeve. A push rod connected to the valve is movable to break the ampule when the valve is first moved to its open position. The materials are mixed within the container and are dispensed through a filter mounted on a dip tube leading to the valve. The dispenser is operable to dispense two component epoxy and polyester adhesives as a foam to selected locations.

12 Claims, 7 Drawing Sheets

DISPENSER

CROSS REFERENCE TO RELATED APPLICATIONS

This application is a continuation-in-part of U.S. patent application Ser. No. 261,320 filed Oct. 24, 1988, now U.S. Pat. No. 4,979,638 and U.S. patent application Ser. No. 251,806 filed Oct. 3, 1986, now U.S. Pat. No. 4,941,615. Application Ser. No. 261,320 is a continuation-in-part of U.S. application Ser. No. 049,361 filed May 14, 1987. Application Ser. No. 049,361 is a continuation of U.S. application Ser. No. 812,237 filed Dec. 23, 1985, now abandoned.

FIELD OF INVENTION

The invention relates to a dispenser for holding two materials which must normally be maintained in separated conditions until immediately prior to use.

BACKGROUND OF INVENTION

Many compounds would be advantageously used if they could be dispensed from an aerosol container. Some of these compounds have a relatively short life and cannot be intermixed until just prior to use. Aerosol containers that include a frangible secondary container have been used to hermetically separate two chemical ingredients that must be mixed together immediately prior to spraying, such as a resinous paint and a catalyst. An inertia means, such as a steel ball, has been placed in the secondary container so that by shaking the entire aerosol container the inertia means shatters the secondary container allowing the two chemicals to be mixed together allowing a chemical mixture to be sprayed to a desired location. An example of this structure is shown by Cronan in U.S. Pat. No. 4,121,772.

SUMMARY OF INVENTION

The invention is directed to dispenser that has a container and an ampule for storing a propellant and materials, such as liquids and chemicals that are to be directed to a desired location. The dispenser stores two or more separated materials is a container and ampule that are mixed together within the container immediately prior to use. A wide range of ratios of materials can be selected by using different size ampules for storing secondary materials. The dispenser can be effectively used with an aerosol spray containing cyanoacrylates. Ampule breaking structure associated with a control valve is manually operated to fracture the ampule thereby allowing the materials in ampule and container to mix with each other. The container can be transparent materials to permit visual inspection of the integrity of the ampule.

The container has an open top that is closed with a cap that supports a normally closed control valve. The control valve has a moveable tubular member which can be manually moved into the container to open the valve to allow propellant and material to be dispensed therefrom. A frangible ampule is located within the container for storing a second material separated and isolated from the first material. The ampule is an elongated closed glass vessel that is positioned within the container. The ampule is normally located in a generally upright position. An annular member, such as a sleeve or ring, located within the chamber has a passage for accommodating a portion of the ampule to retain it in a generally upright position. The ampule breaking structure has a push rod connected to the movable member of the valve. A closure member or button mounted on the tubular member prevents dispensing of propellant and materials from the container when the tubular member is first moved to break the ampule. The rod extends into the passage of the annular member adjacent the side of the ampule. The rod and annular member have cooperating surfaces so that when the movable member is first moved into the chamber the rod crushes or breaks the ampule whereby the second material is mixed with the first material in the chamber. After the ampule is broken the button valve is operated in a normal manner to dispense the mixed materials as a spray or foam to a selected location.

A preferred embodiment of the aerosol dispenser has an elongated cylindrical transparent glass container having a bottom wall, an open top, and a chamber for storing a propellant and material such as a liquid. A cap mounted on the container closes the open top and supports a normally closed control valve. The control valve has an upwardly directed tubular stem that is closed with a closure member or button. The button is replaced with a nozzle so that when the stem is moved relative to a seal to open the valve the propellant and the material is dispensed from the container through the nozzle.

An elongated frangible ampule is located within the chamber for storing a second material separate and isolated from the first material. A rigid cylindrical sleeve accommodates the lower end of the ampule to hold the ampule in a generally upright position in the chamber. This upright position is generally parallel to the longitudinal dimension or length of the chamber. The upright location of the ampule in the chamber allows a relatively large ampule to be stored within the chamber. This allows the aerosol dispenser to have a large range of ratios of the first and second materials. The second material in the ampule being separated and isolated from the first material in the container increases the shelf life of the product and minimizes the deteriation of the gasket and seal structures of the control valve. The sleeve has open upper and lower ends. The upper end of the sleeve has an inside annular downwardly tapered edge or chamber. A rigid rod connected to the movable member extends downwardly into the passage of the sleeve. The rod has a downwardly directed finger that is located within the passage adjacent the ampule. A beveled shoulder on the rod adjacent to the finger cooperates with tapered edge on the sleeve to force the rod into the side of the ampule to break the ampule when the stem is moved down or depressed. The second material in the ampule flows into the chamber where it is mixed with the first material and propellant. A dip tube having a filter at the lower end thereof carries the mixed materials and propellant into the valve when the valve is open thereby allowing the mixed materials to be dispensed to a desired location. A valve actuator nozzle is provided with an elongated tube which allows the materials to be accurately dispensed to a desired location.

Another embodiment of the aerosol dispenser has an elongated cylindrical transparent glass container having a bottom wall, an open top, and a chamber for storing a propellant and material such as a liquid. A cap mounted on the container closes the open top and supports a normally closed control valve. The control valve has an upwardly directed tubular stem that can be moved relative to a seal to open the valve. An actuator button is mounted on the outer end of the stem in a tight fitting relationship actuator so that the propellant and the material cannot be dispensed from the container.

An elongated frangible ampule is located within the chamber for storing a second material separate and isolated from the first material. The second material in the ampule being separated and isolated from the first material in the container increases the shelf life of the product and minimizes the deteriation of the gasket and seal structures of the control valve. A rod having a saddle shaped foot accommodates the mid section of the ampule to hold the ampule adjacent the bottom wall of the container. The rod is connected to the inner end of the tubular stem. When the actuator button is depressed, the tubular stem and rod are moved inwardly to force the saddle foot into the ampule to break the ampule. The second material in the ampule flows into the chamber where it is mixed with the first material and propellant. The inward movement of the tubular stem opens the valve. The actuator button is friction sealed to the outer end of the stem to prevent the propellant and materials from being dispensed from the container when the valve is first opened. This avoids product waste and inadvertant application of the materials to undesired areas. The proper mixing ratios of the propellant and materials is maintained as one of the substances is not discharged before combining with the other substances. Also, potential environmental contamination is reduced. When the mixed materials and propellant are ready to be dispensed from the container, the button is replaced with a valve actuator cap having an opening or nozzle to allow the release of the contents of the container. A dip tube having a filter at the lower end thereof carries the mixed materials and propellant into the valve when the valve is open thereby allowing the mixed materials to be dispensed to a desired location. The valve actuator is provided with an elongated tube which allows the materials to be accurately dispensed to a desired location.

The objects and advantages of the aerosol dispenser of the invention are embodied in the dispenser structure and functions as shown in the drawing and described in the specification of the preferred embodiment thereof.

DESCRIPTION OF PREFERRED EMBODIMENTS

Figure 1:
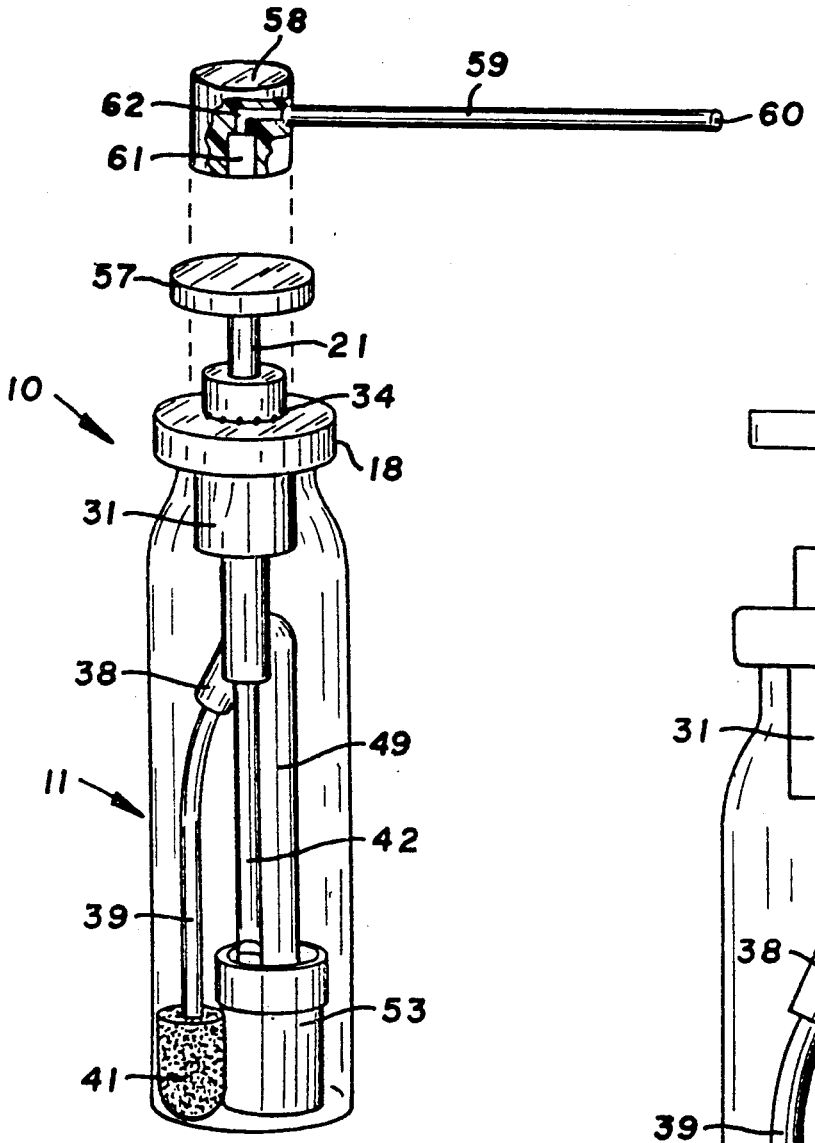
FIG. 1 is a perspective view of the aerosol dispenser of the invention equipped with an actuator button and a nozzle, partly sectional, having a dispensing tube for directing mixed materials to a desired location.
Figure 2:
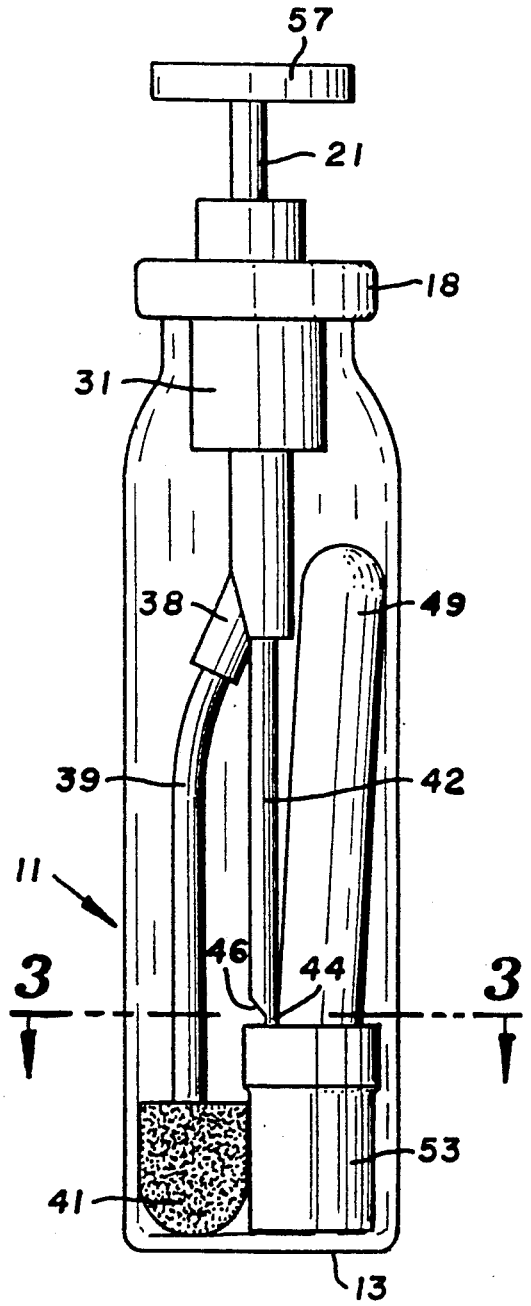
FIG. 2 is an enlarged front elevational view of FIG. 1.
Figure 3:
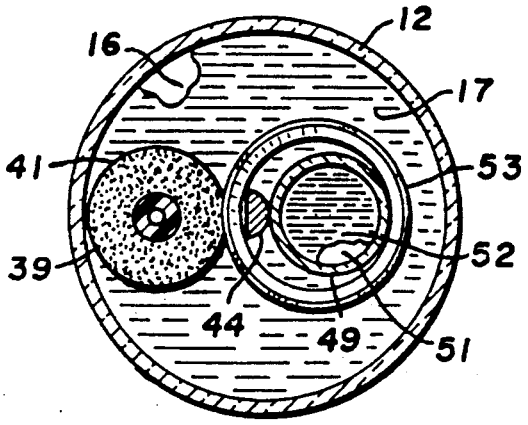
FIG. 3 is an enlarged sectional view taken along the line 3—3 of FIG. 2.

Referring to FIGS. 1, 2, and 3, there shown the aerosol dispenser 10 of the invention for delivering mixed materials with a propellant to a desired location. The materials within dispenser 10 are mixed immediately prior to use so that corrosive materials have a minimum effect on gaskets and sealing elements of the control valve. The dispenser 10 has substantial shelf life since there is little or no reaction within the container prior to the mixing of the materials within the container. The dispenser can be used with two component materials, such as cyanoacrylates and opoxy and polyester adhesives.

Dispenser 10 has an external bottle or container 11 made out of transparent material such as glass, plastic or the like. Bottle 11 has a cylindrical side wall 12 joined to a generally flat bottom wall 13. The top of side wall 12 has an annular rim or bead 14 surrounding the opening or mouth into chamber 16 of container 11. A material 17 such as liquid, is normally stored in a chamber 16 along with a propellant which maintains material 17 under pressure within chamber 16. The open top of the container 11 is closed with a cap 18 that supports a normally closed control valve indicated generally at 19.

Figure 4:
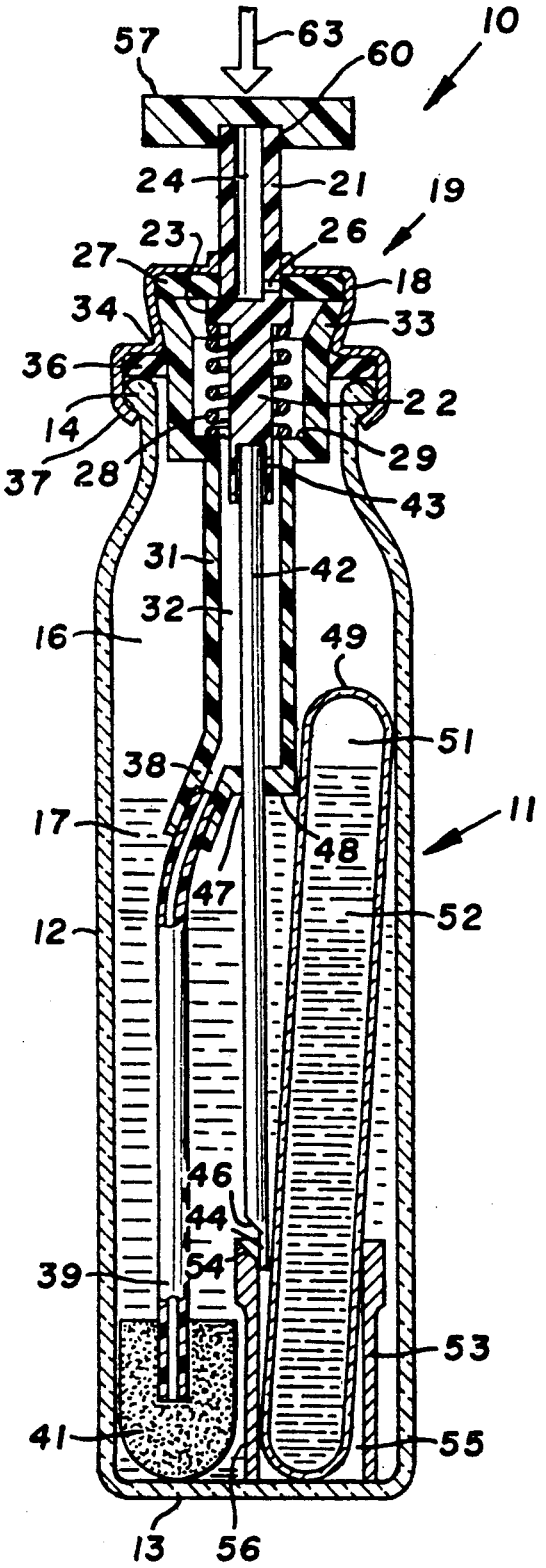
FIG. 4 is an enlarged longitudinal sectional view of the dispenser of FIG. 2.

As shown in FIG. 4, control valve 19 has a generally upright tubular stem 21 that projects upwardly from cap 18. The lower portion of stem 21 has an elongated body 22 having an outwardly directed annular flange 23. Stem 21 has a passage 24 open to the top of the stem and open to a side port 26 that allows the propellant and the material to flow into passage 24. An annular diaphram 27 surrounding stem 21 is normally aligned with the side port 26 to maintain the valve in a closed position. A coil spring 28 engages flange 23 to hold stem 21 in an up or closed position. The lower or inner end of coil spring 28 bears against an annular shoulder 29 of a generally cup-shaped housing 31 that surrounds stem body 22. Housing 31 has an internal chamber 32 that allows the propellant and material to flow upwardly to the side port 26 when control valve 19 is in the open position. Spring 28 biases stem 21 in a closed position as shown in FIG. 4. The upper end of housing 31 has an outwardly directed annular lip 33 that bears against the bottom of diaphram 27. Cap 18 is provided with an inwardly directed annular crimp 34 to hold lip 33 in engagement with diaphram 27. This also holds housing 31 on cap 18. An annular gasket 36 surrounds housing 31 and bears against the top of the bead 14 of container 11. Cap 18 is turned about or clamped over the gasket 36 and bead 14 to seal cap 18 on container 11.

The lower portion of housing 31 has a laterally and downwardly directed nipple 38 that is secured to an elongated dip tube 39. Tube 39 extends to adjacent the bottom wall 13 of container 11. A cup-shaped filter 41 fits over the lower end of dip tube 31 to prevent particulates, such as glass particles and the like, from flowing into the valve and being dispensed from the dispenser. Filter 41 is a porous polyethylene generally cylindrical member. The pore size of filter 41 is in the range of 45 to 75 microns. The bottom of filter 41 has a semi-spherical shape. The lower end of dip tube 39 fits into a hole extended down into filter 41. Other types of filters can be used with dip tube 39 to prevent foreign particles from interferring with the operation of control valve 19.

The lower portion of body 22 is secured to a downwardly directed compression or push rod 42. Push rod 42 is an elongated rigid member having a smooth outer cylindrical outer surface joined to the bottom part of stem 21 so that rod 42 moves with stem 21. Rod 42 is a stainless steel wire rod having a continuous and smooth cylindrical outer surface. Other types of materials can be used to make rod 42. The upper end of rod 42 fits into a hole or recess 43 in the bottom of body 22. Rod 42 extends downwardly through a hole 47 in bottom wall 48 of housing 31. Rod 42 is in a close sliding fit relation with bottom wall 47 to prevent foreign particles from entering passage 32. Spring 28 also serves as a stop to limit the depression or inward movement of stem 21. Stem 22 has a diameter that is smaller than the diameter of passage 32 so that the propellant and liquid can freely flow to side port 26 when port 26 is moved below diaphram 27 to allow the material to flow through the valve and be dispensed to a desired location.

As shown in FIGS. 2 to 5, the bottom of rod 42 has a downwardly directed finger 44. Finger 44 has a width less than one half the diameter of rod 42. Finger 44 is located adjacent a wedge or shoulder surface 46 on the lower end of rod 42. The surface 46 is preferably at an angle of 45 degrees relative to the longitudinal axis of rod 42. Other angles can be used for wedge shoulder 46. Finger 44 extends downwardly generally parallel to the longitudinal axis of rod 42. The upper end of finger 44 has opposite side edges that diverge upwardly to the opposite side edges of shoulder 46.

An elongated cylindrical frangible ampule 49 having a sealed chamber 51 storing a second material 52 such as liquid, chemical, powders, and the like that is desired to be mixed with material 17 in chamber 16 immediately prior to use of the dispenser. Ampule 49 is a glass vessel located generally along the length of chamber 16. This allows a relatively large ampule to be located within chamber 16 so that a wide range of ratios of amounts of materials can be mixed in chamber 16. The diameter of ampule 49 is smaller than the diameter of the opening into chamber 16. The length of ampule 49 can be substantially the same as the longitudinal length of chamber 16. The size of ampule 49 is selected to provide the desired ratio of volumes of material 17 to material 52.

Ampule 49 is retained in its generally upright or longitudinal position with a cylindrical sleeve or holding member 53. Sleeve 53 bears against the bottom wall 13 of container 11 and has a passage 55 that accommodates a lower end of ampule 49. Sleeve 42 is a one-piece cylindrical metal member having an outside diameter slightly smaller than the opening into chamber 16 whereby sleeve 53 can be placed into chamber 16. As seen in FIG. 4, sleeve 53 has inwardly directed annular chamfer or beveled edge 54 at the top end thereof. The lower outside wall of sleeve 53 has an annular groove 56 providing space for filter 41 whereby sleeve 53 and filter 41 are located adjacent bottom wall 13 of container 11. Preferably, the angle of edge 54 is at 45 degrees relative to the longitudinal axis of the passage 55 of sleeve 53. Other angles can be used for edge 54. Sleeve 53 has open top and bottom ends so that material is not trapped in passage 55. Finger 44 is located in the upper end of sleeve 53 when valve 19 is in the closed position. Wedge shoulder 46 is spaced from edge 54. Finger 44 is located contiguous to the side wall of ampule 49. Ampule 49 is not broken so that the material 52 therein is isolated from material 17 in chamber 16. The structural condition of ampule 49 can be visually observed through the transparent material of container 11.

The upper end of stem 22 accommodates a generally circular button or closure member 57 that closes passage 24. The bottom of button 57 has a central circular recess or hole 60 that accommodates the upper end of stem 21. Button 57 has a tight fit on stem 21. Button 57 is used to apply force as indicated by arrow 63 in FIG. 4 in a downward direction on stem 21. This moves valve 19 to the open position and rod 42 in a downward direction as indicated by arrow 64 in FIG. 5. Button 57 prevents materials and propellant under pressure in chamber 16 from being discharged from stem 21. The wedge shoulder 46 engages edge 54 causing the lower end of rod 42 to move laterally into tight engagement with the side of ampule 49. Continued downward movement of rod 42 continues to exert lateral force on the ampule 49 and wedges the lower end of rod 42 between the inside of wall of sleeve 3 and ampule 49. This force of rod 42 against ampule 49, indicated by arrow 65 in FIG. 5, fractures or breaks ampule 49 thereby releasing material 52 into chamber 16 where it is mixed with material 17. The mixing of the materials can be facilitated by shaking dispenser 10. The sleeve 53 is free to move up and down as indicated by the arrow 66. This allows the materials in passage 55 to be thoroughly mixed with all of the material in chamber 16.

As soon as ampule 49 is broken, the external force 63 on button 57 can be removed. Spring 28 will then move stem 21 to its closed position as shown in FIG. 4. Button 57 is then removed from stem 21 and replaced with a cap actuator 58. As shown in FIG. 1, cap actuator 58 has a elongated lateral tube 59 having a discharge orfice 60. The bottom of cap 58 has a bore 61 that telescopes over the top of stem 21. Bore 61 is to open to a passage 62 that leads laterally to tube 59. Other types of cap actuators and discharge nozzles can be used with stem 21 to direct the aerosol spray to desired locations.

Dispenser 10 is stored and transported in the manner shown in FIGS. 1 and 2. A cover (not shown) can be placed over botton 57 and fitted on cap 18. The control valve 19 is closed thereby confining the liquid 17 and propellant under pressure to chamber 16. Ampule 49 being a hermetically sealed vessel separates and isolates the material 52 from the material 17 and propellant in chamber 16. This substantially increases the shelf life of liquids 17 and 52 and minimizes deteriation of the seal materials of control valve 19. The separation of the first and second materials also allows the dispenser to use cyanoacrylates and two component adhesives.

The cylinder 53 and sealed ampule 49 containing liquid 52 are placed in chamber 16 through the top opening before the cap 18 is attached to rim 14. Cap 18 and control valve 19 are placed on top of container 11 as a unit. The rod 42 extends down into chamber 16 to locate finger 44 within the top of sleeve 53 adjacent the side of ampule 49. Material 17 can be placed in chamber 16 before cap 18 is placed on container 11. Propellant can be introduced into chamber 16 through stem 21 by opening valve 19.

Figure 5:
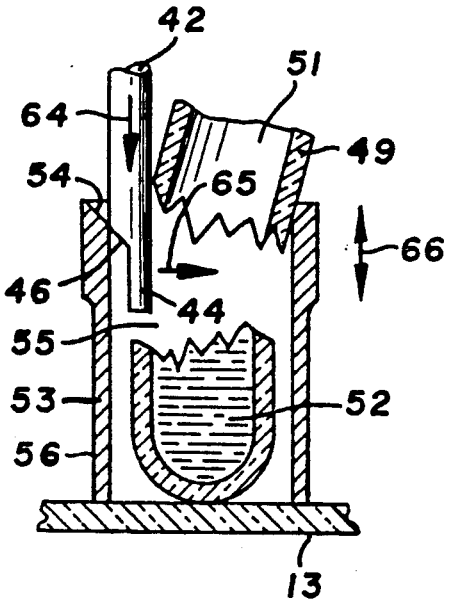
FIG. 5 is an enlarged sectional view showing the breaking of the ampule with the push rod in the sleeve within the container.

In use the operator applies force 63 on button 57 to move stem 21 down into container 11. This opens the control valve 19 and moves push rode 42 down into sleeve 53. Button 57 mounted on the upper end of stem 21 prevents material and propellant under pressure in chamber 16 from being discharged from stem 21. The shoulder 46 engages beveled edge 54 of sleeve 53 to force rod 42 laterally to break ampule 49, as shown in FIG. 5. Material 52 in ampule 49 mixes with material 17. Button 57 is replaced with cap actuator 58. Dispenser is now ready for use to dispense the mixed materials and propellant to a location.

Referring to FIGS. 6 to 10, there is shown a first modification of the dispenser of the dispenser of the invention indicated generally at 110. Dispenser 110 has a container or bottle 111 made out of transparent materials such as glass including a generally cylindrical side wall 112 and a bottom wall 113. Container 111 has an internal closed chamber 116 that stores a first material such as a liquid and propellant. A cap 118 closes the mouth of the container and supports a normally closed control valve (not shown). The control valve has the same structure as the control valve 19 shown in FIG. 4. The control valve includes an upwardly directed tubular stem 121 that accommodates a button or closure member 157 that normally closes the stem. The stem 121 extends downwardly through the valve and is joined to a downwardly directed body 122 that has a recess or hole 143 for a downwardly directed push rod 142. A valve housing 131 has laterally directed nipple 138 that is joined to a dip tube 139. The lower end of dip tube 139 fits into a filter 141. Filter 141 has the same structure as the filter 41 shown in FIG. 3.

Figure 7:
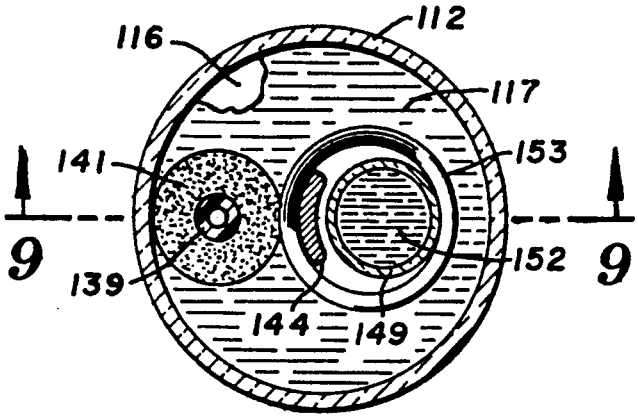
FIG. 7 is an enlarged sectional view taken along the line 7—7 of FIG. 6.
Figure 9:
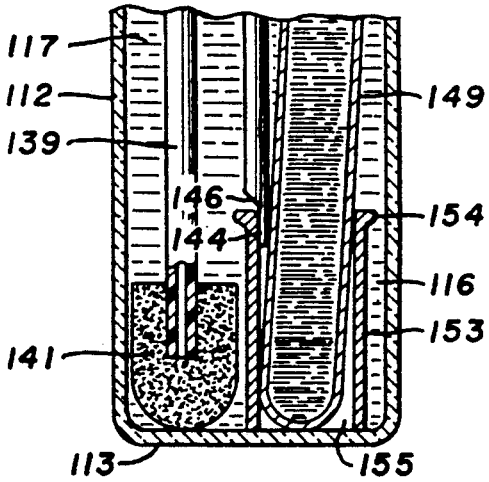
FIG. 9 is a longitudinal sectional view of the lower section of the dispenser of FIG. 1 showing the integrity of the ampule within the container.
Figure 8:
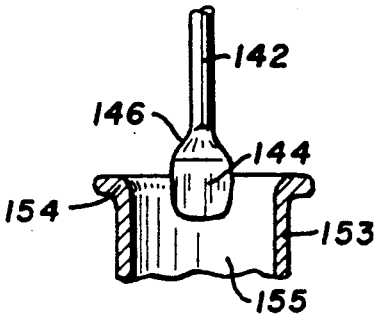
FIG. 8 is an enlarged sectional view taken along the line 8—8 of FIG. 6.

Push rod 142 is an elongated cylindrical metal member. The lower end of the member is flattened to form a finger 144. When finger 144 is formed by forging, a downwardly inclined shoulder or wedge surface 146 is formed at the upper end of the finger and lower end of the cylindrical rod 142. The finger 144 is formed into a generally arcuate configuration as shown in FIG. 7 and is located adjacent a side portion of an ampule 149. Ampule 149 has a sealed chamber 151 that contains a second material 152 such as a liquid that is to be mixed with the liquid 117 in the chamber 116.

Finger 144 extends downwardly into a sleeve or annular member 153. Member 153 has a top annular bead or rim 154 that has an inside edge that engages the shoulder 146 when the push rod 142 is moved down. Ampule 149 extends in a generally upright position in a passage 155 of sleeve 153. The sleeve 153 holds the ampule 149 generally parallal to the longitudinal axis or length of chamber 116 so that a relatively large ampule 149 can be placed in chamber 116.

Figure 10:
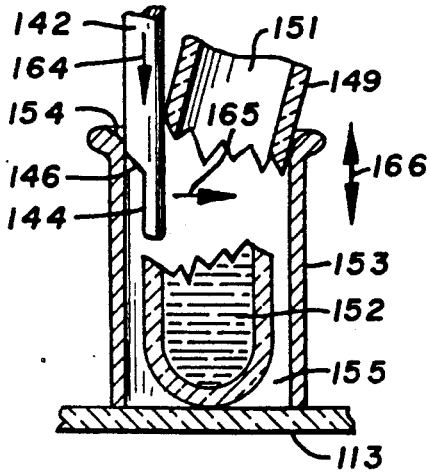
FIG. 10 is an enlarged longitudinal sectional view showing the breaking of the ampule with the push rod.

Referring to FIG. 10, when push rod 142 is moved down the shoulder 146 will ride on the inside surface the bead 154 causing the push rod finger 144 to move laterally as indicated by the arrow 165. This will break the frangible material of the ampule 149. The material 152 is then free to mix to the material 117 in chamber 116. This is facilitated by shaking the container 111 as indicated by the arrow 116.

Figure 6:
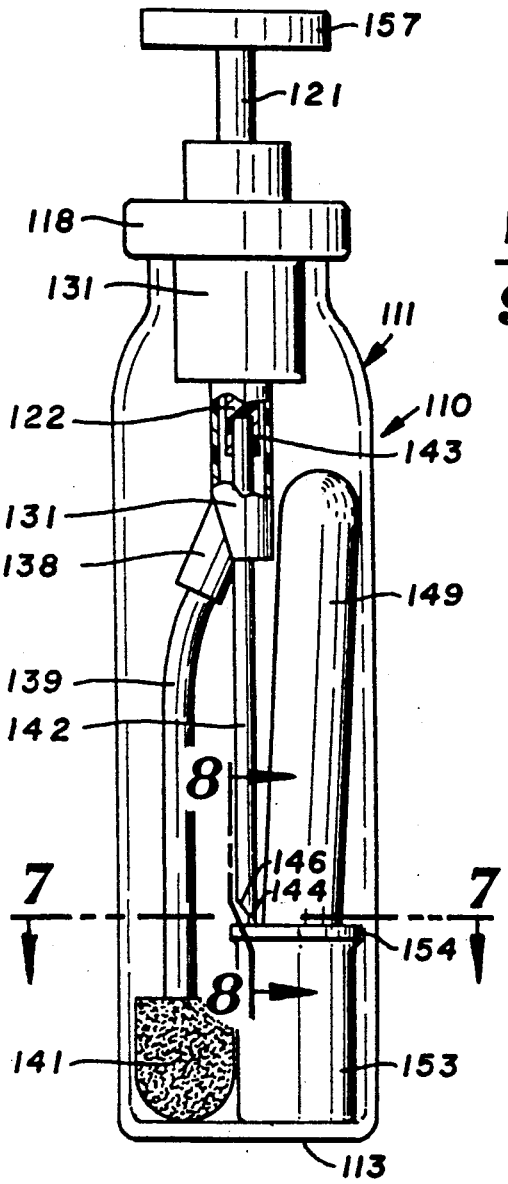
FIG. 6 is a front elevational view of a first modification of the aerosol dispenser of the invention.

As seen in FIG. 6 the transparent bottle 11 allows the user to visually observe the sealed and or broken condition of ampule 149. The buttom 157 is removed from stem 121 replaced with a nozzle such as nozzle 58 shown in FIG. 1 so that the mixed materials can be dispensed to a desired location.

Figure 11:
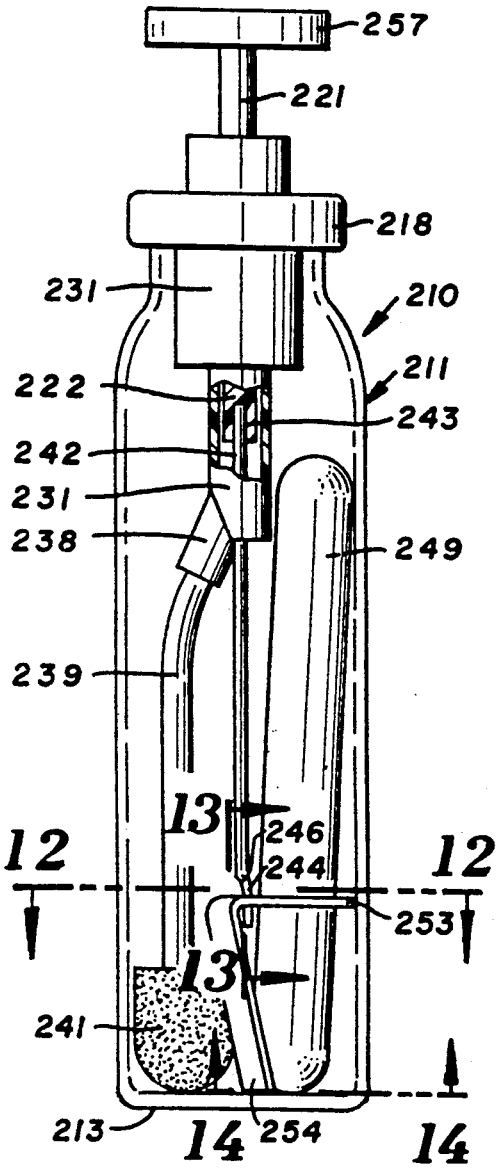
FIG. 11 is a front elevational of a second modification of the aerosol dispenser of the invention.
Figure 12:
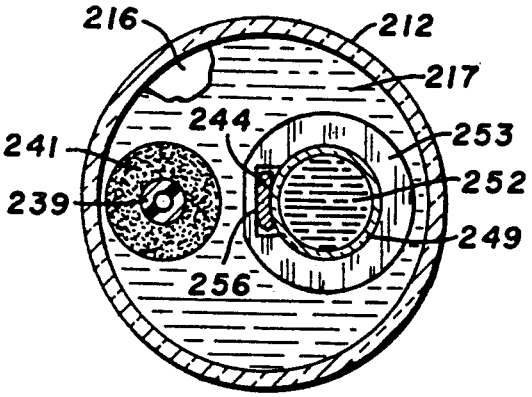
FIG. 12 is an enlarged sectional view taken along the line 12—12 of FIG. 11.
Figure 15:
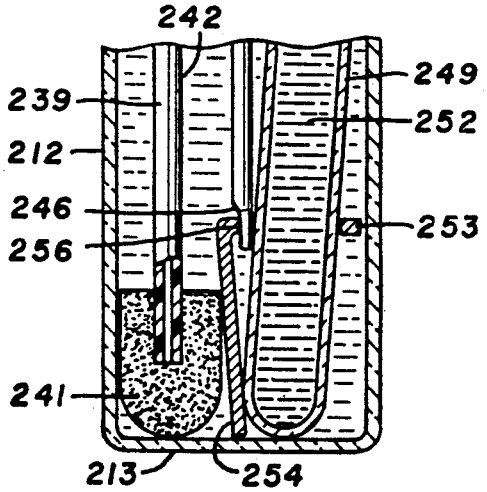
FIG. 15 is an enlarged longitudinal sectional view of the lower section of the dispenser of FIG. 11 showing the ampule in stored unbroken condition.
Figure 13:
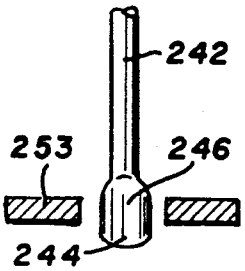
FIG. 13 is an enlarged sectional view taken along the line 13—13 of FIG. 11.

Referring to FIGS. 11 to 16 there is shown a second modification of the dispenser of the invention indicated generally at 210. Dispenser 210 has structure that corresponds to dispenser 10 as shown in FIGS. 1 to 6 that is indicated by the reference numeral having a suffix 2. Dispenser 210 has a container of bottle 211 of transparent material including a side wall 212 and bottom wall 213 surrounding a chamber 216. A first material such as a liquid 217 and a propellant is stored under pressure in chamber 216. A cap 218 mounted on the top of container 211 closes the mouth of the container and supports a normally closed control valve (not shown). The control valve located within a housing 231 has an upwardly directed tubular stem 221 and downwardly extended body 222 joined to stem 221. Housing 231 has a laterally directed nipple 238 that is connected to a dip tube 239. A filter 241 is mounted on the bottom of dip tube 239. Filter 241 is identical in structure and function to the filter 41 shown in FIG. 3. An elongated generally cylindrical push rod 242 has an upper end that fits into a hole or recess 243 in the end of body 222. Push rod 241 ends through the bottom of housing 231 and terminates in a downwardly directed generally flat finger 244. Finger 244 is formed by forging or pressing the end of the rod to a generally flat shape. As seen in FIG. 12 the finger 244 has a slight transverse curve that follows the curvature of the side wall of the ampule 249. The lower end of push rod 242 also contains downwardly and inwardly directed shoulder or wedge surface 246 that are formed during the forging of finger 244.

Figure 14:
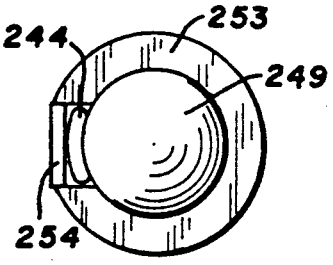
FIG. 14 is an enlarged sectional view taken along the line 14—14 of FIG. 11.
Figure 16:
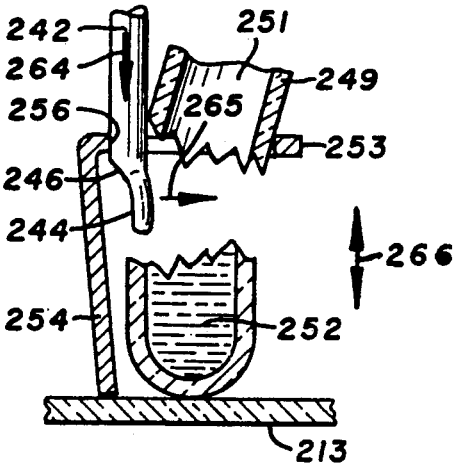
FIG. 16 is an enlarged sectional view showing the breaking of the ampule with the push rod.
Figure 17:
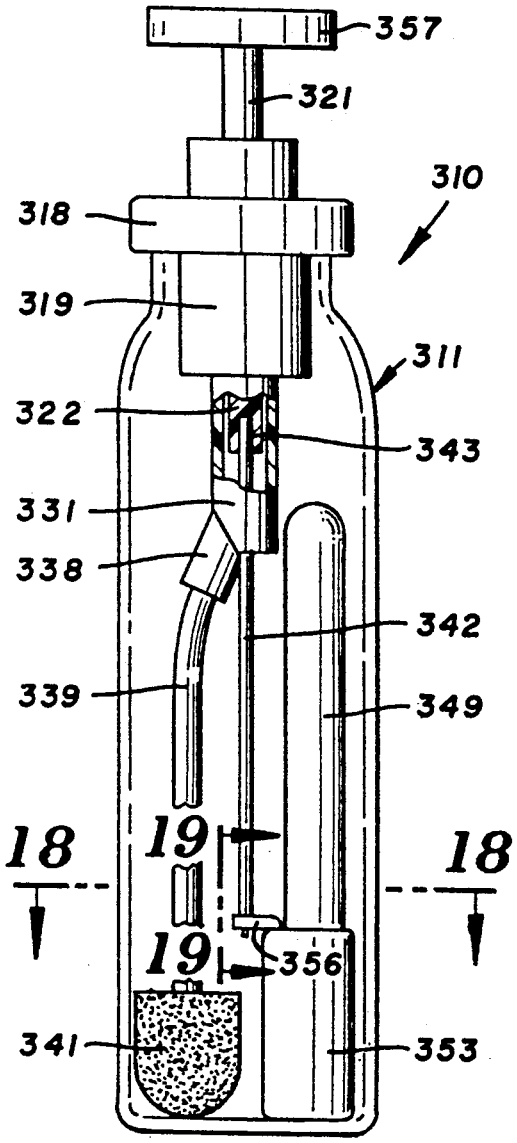
FIG. 17 is a front elevational view of a third modification of the aerosol dispenser of the invention.
Figure 18:
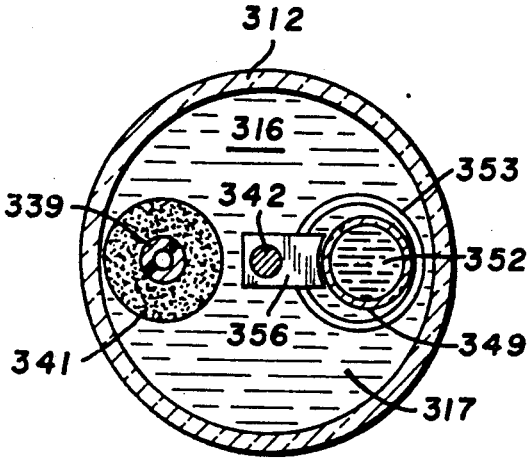
FIG. 18 is an enlarged sectional view taken along the line 18—18 of FIG. 17.

Ampule 249 is an elongated cylindrical glass vessel that has a sealed internal chamber 251 containing a second material or liquid 252. The ampule fits into a annular member or holder 253. Holder 253 is a generally flat ring joined to a downwardly directed leg 254. As seen in FIG. 14 leg 254 has a generally arcuate configuration that follows the outside curvature of ampule 249. Leg 254 is bent inwardly to frictionally retain the ampule 249 in the generally upright position or along the longitudinal length of the chamber 216.

The transparent material of container 211 allows for the visual inspection of the integrity of ampule 249 as seen in FIG. 11. When the push rod 242 is moved in a downward direction by applying force on the button 257 the shoulder 246 engages the edge 256 of annular member 253. The continued downward movement of push rod 242, as indicated by arrow 264 in FIG. 16, causes the finger 244 to move in the lateral direction as indicated by the arrow 265. This will break the frangible material of ampule 249. The second material 252 will then mix with the material 217 in chamber 216. The mixing is facilitated by shaking the container as indicated by the arrow 266.

Referring to FIG. 17 to 21 there is shown in a third modification of the dispenser of the invention indicated generally at 310. Dispenser 310 has a structure that is similar to the structure of dispenser 10 of FIGS. 1 to 6 which structure has same reference numerals with a suffix 3.

Dispenser 310 has a transparent container of bottle 311 having a side wall 312 and a bottom wall 313 surrounding a chamber 316. A first material 317 such as a liquid and propellant under pressure is stored in chamber 316 and retained therein with a cap 318. Cap 318 supports a normally closed control valve 319 that is identical in structure to the valve 19 shown in FIG. 4. The control valve 319 has an upwardly directed tubular stem 321 and a downwardly directed body 322. A cap 357 fits on top of stem 321 to close the exit passage in the stem. Control valve 319 is surrounded with a housing 331 having a lateral nipple 338. A downwardly extended dip tube 339 is joined to nipple 338 and a filter 341. Filter 341 is identical in structure and function to the filter 41 shown in FIG. 3.

Figure 20:
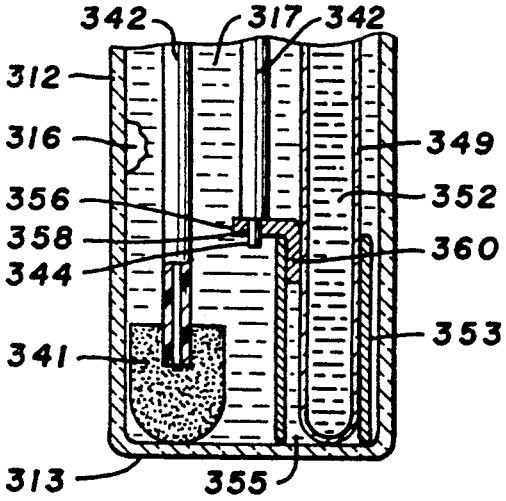
FIG. 20 is an enlarged longitudinal section view of the lower portion of the dispenser FIG. 17 showing the ampule in its stored unbroken condition.
Figure 19:
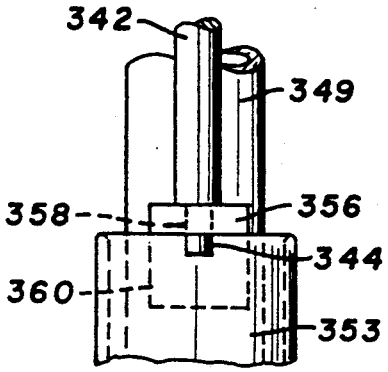
FIG. 19 is an enlarged sectional view taken along the line 19—19 of FIG. 17.

An elongated rigid push rod 342 extends upwardly into housing 331 and into a recess 343 in the bottom of body 322 so that the push rod 342 moves with stem 321. The lower end of push rod 342 has a finger 344 extended downwardly adjacent to the side of an ampule 349 made of frangible material such as glass. Ampule 349 stores a second material or liquid 352 that is to be mixed with the material 317 in chamber 316 to provide the desired mixture of materials that is to be dispensed from the dispenser. Finger 344 as seen in FIG. 20 fits into a hole 358 in an angle member 356. Member 356 is pivotally mounted on top of a sleeve 353. The lower end of ampule 349 extends into the passage 355 of sleeve 353. Member 356 has a downwardly directed leg 360 extended into passage 355 adjacent ampule 349 as shown in FIG. 20. Leg 360 has a convex curve to accommodate the curvature of ampule 349. The vertex of member 356 engages the upper edge 354 of sleeve 353 so that member 356 is supported on sleeve 353 for pivotal movement about a generally horizontal axis. The upper edge 354 of sleeve 353 is rounded to promote the pivoted movement of member 356. The lower ede of sleeve 353 is also rounded so that the orientation of sleeve 353 in container 311 is not critical.

Figure 21:
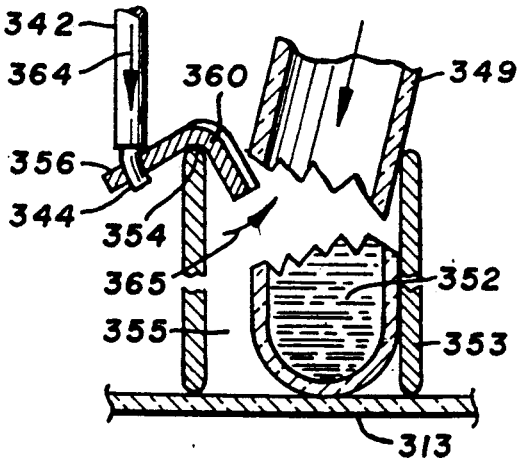
FIG. 21 is an enlarged sectional view similar to FIG. 20 showing the breaking of the ampule with the push rod and angle member.

When downward force is applied to cap 357, stem 321, body 322, and rod 342 move downward as indicated by arrow 364 in FIG. 21. Member 356 pivots on upper edge 354 forcing leg 360 into the side of ampule 349 as shown by arrow 365 to break the ampule. The material 352 flows out of ampule 349 and mixes with material 317 in container 312. After the ampule 349 is broken, cap 357 is removed from stem 321 and replaced with a nozzle such as nozzle 58 shown in FIG. 1.

Referring to FIGS. 22 to 25, there is shown a fourth modificaton of the aerosol dispenser 410 of the invention for delivering mixed materials with a propellant to a desired location. The materials within dispenser 10 are mixed immediately prior to use so that corrosive materials have a minimum effect on gaskets and sealing elements of the control valve. Dispenser 410 has substantial shelf life since there is little or no reaction within the container prior to the mixing of the materials within the container. The dispenser 410 can be used with materials such as cyanoacrylates, pharmaceutical drugs and two part adhesives.

Dispenser 410 has an external bottle or container 411 made out of transparent material such as glass, plastic or the like. Bottle 411 has a cylindrical side wall 412 joined to a generally flat bottom wall 413. The top of side wall 412 has an annular rim or bead 414 surrounding the opening or mouth into chamber 416 of container 411. A material 417 such as a liquid, is normally stored in a chamber 416 along with a propellant which maintains material 417 under pressure within chamber 416. The open top of the container 411 is closed with a cap 418 that supports a normally closed control valve indicated generally at 419.

Figure 26:
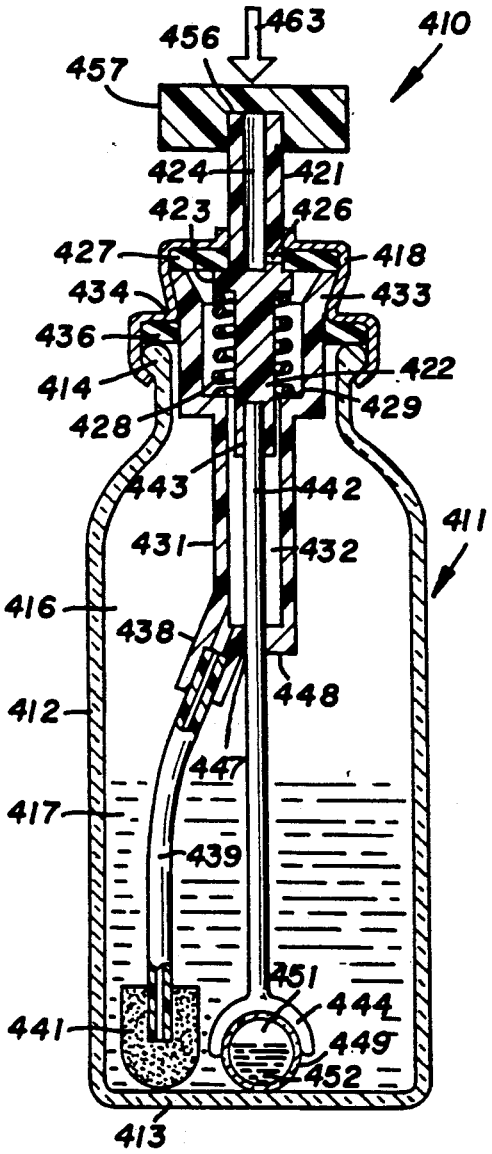
FIG. 26 is a sectional view taken along the line 26—26 of FIG. 24 showing the unbroken ampule stored in the container.
Figure 27:
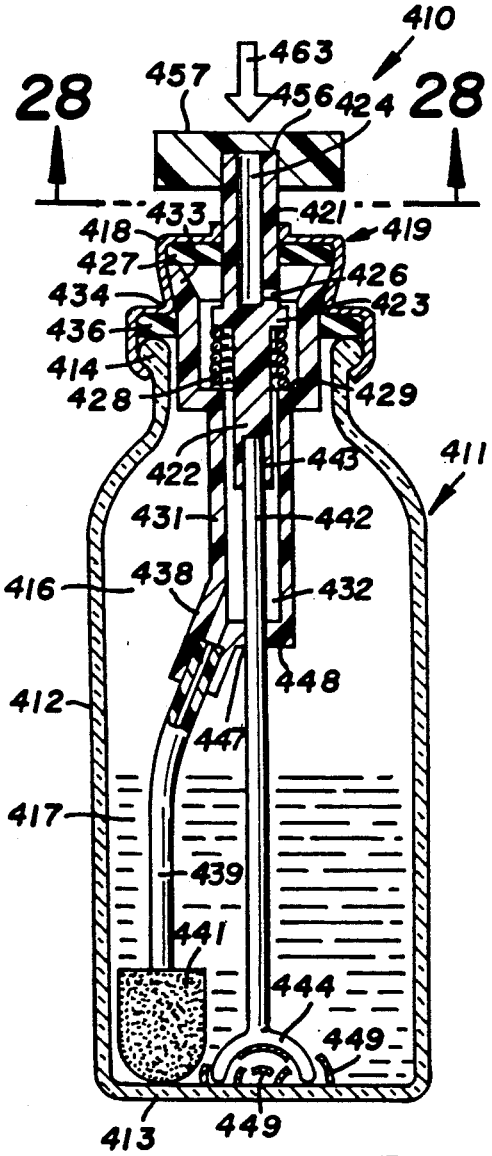
FIG. 27 is a sectional view similar to FIG. 26 showing the broken ampule.
Figure 28:
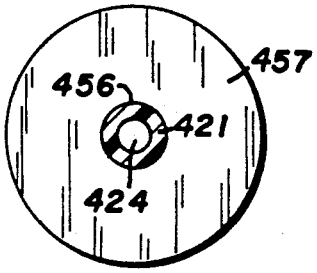
FIG. 28 is an enlarged sectional view taken along the line 28—28 of FIG. 27.

As shown in FIGS. 26 and 27, control valve 419 has a generally upright tubular stem 421 that projects upwardly from cap 418. The lower portion of stem 421 has an elogated body 422 having an outwardly directed annular flange 423. Stem 421 has a passage 424 open to the top of the stem and open to a side port 426 that allows the propellant and the material to flow into passage 424. An annular diaphram 427 surrounding stem 421 is normally aligned with the side port 426 to maintain the valve in a closed position. A coil spring 428 engages flange 423 to hold stem 421 in an up or closed position. The lower or inner end of coil spring 428 bears against an annular shoulder 429 of a generally cup-shaped housing 431 that surrounds stem body 422. Housing 431 has an internal chamber 432 that allows the propellant and material to flow upwardly to the side port 426 when control valve 419 is in the open position. Spring 428 biases stem 421 in a closed position as shown in FIG. 26. The upper end of housing 431 has an outwardly directed annular lip 433 that bears against the bottom of diaphram 427. Cap 418 is provided with an inwardly directed annular crimp 434 to hold lip 433 in engagement with diaphram 427. This also holds housing 431 on cap 418. An annular gasket 436 surrounds housing 431 and bears against the top of the bead 414 of container 411. Cap 418 is turned about or clamped over the gasket 436 and bead 414 to seal cap 418 on container 411.

The lower portion of housing 431 has a laterally and downwardly directed nipple 438 that is secured to an elongated dip tube 439. Tube 439 extends to adjacent the bottom wall 413 of container 411. A cup-shaped filter 441 fits over the lower end of dip tube 439 to prevent particulates, such as glass particles and the like, from flowing into the valve and being dispensed from the dispenser. Filter 441 is a porous polyethylene generally cylindrical member. The pore size of filter 441 is in the range of 45 to 75 microns. The bottom of filter 441 has a semi-spherical shape. The lower end of dip tube 439 fits into a hole extended down into filter 441. Other types of filters can be used with dip tube 439 to prevent foreign particles from interferring with the operation of control valve 419.

The lower portion of body 422 is secured to a downwardly directed compression or push rod 442. Push rod 442 is an elongated rigid member having a smooth outer cylindrical outer surface joined to the bottom part of stem 421 so that rod 442 moves with stem 421. Rod 442 is a stainless steel wire rod having a continuous and smooth cylindrical outer surface. Other types of materials can be used to make rod 442. The upper end of rod 442 fits into a hole or recess 443 in the bottom of body 422. Rod 442 extends downwardly through a hole 447 in bottom wall 448 of housing 431. Rod 442 is in a close sliding fit relation with bottom wall 448 to prevent foreign particles from entering passage 432. Spring 428 also serves as a stop to limit the depression or inward movement of stem 421. Stem body 422 has a diameter that is smaller than the diameter of passage 432 so that the propellant and liquid can freely flow to side port 426 when port 426 is moved below diaphram 427.

Figure 25:
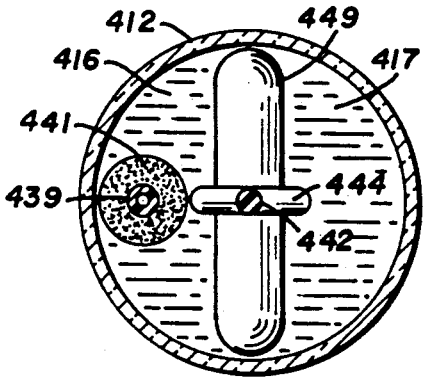
FIG. 25 is a view taken along the line 25—25 of FIG. 23.

As shown in FIGS. 25 to 27, the bottom of rod 442 has a saddle shaped foot 244. Foot 244 is adapted to partially encircle and trap an elongated cylindrical frangible ampule 249 against the bottom wall 213 of container 211. Ampule 249 has a sealed chamber 251 storing a second material 252 such as liquid, chemical, powders, and the like that is desired to be mixed with material 217 in chamber 216 immediately prior to use of the dispenser. Ampule 249 is a glass vessel located generally transversely along the bottom wall 213 of container 211. The diameter of ampule 249 is smaller than the diameter of the opening into chamber 216. The length of ampule 249 can be substantially the same as the transverse length or diameter of bottom wall 213. The size of ampule 249 is selected to provide the desired ratio of volumes of material 217 to material 252.

Figure 24:
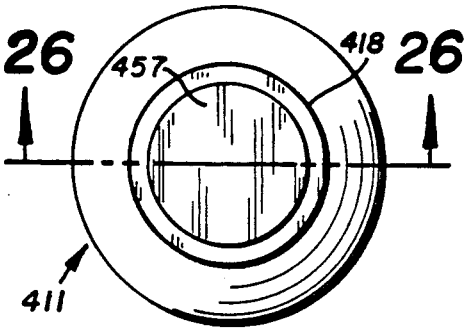
FIG. 24 is a top plan view of FIG. 23.

Ampule 249 is retained in its generally transverse position with foot 244. As seen in FIG. 24, foot 444 is located contiguous to the mid-section of ampule 449. Ampule 449 is not broken so that the material 452 therein is isolated from material 417 in chamber 416. The structural condition of ampule 449 can be visually observed through the transparent material of container 411. The upper end of stem 422 accommodates a generally circular button or closure member 457 that closes passage 424. Button 457 has a centrally located hole 456. Valve stem 421 is located in a close friction fit relation with hole 456 to effectively seal passage 424, as shown in FIG. 27. Button 457 is used to apply force as indicated by arrow 463 in FIG. 25 in a downward direction on stem 221. This moves valve 419 to the open position and rod 442 in a downward direction. Continued downward movement of rod 442 continues to exert force on the ampule 449 and wedges the ampule 449 between the bottom wall 413 of container 411 and foot 444. This force of foot 444 against ampule 449 in FIG. 25, fractures or breaks ampule 449 thereby releasing material 452 into chamber 416 where it is mixed with material 417. The mixing of the materials can be facilitated by shaking dispenser 410. Button 457 prevents the materials 417 and 452 from being discharged from the chamber 416. This eliminates wasted or unexpected discharge of the materials which could be expensive or dangerous. Drugs and other pharmaceutical aerosols that require exact mixing ratios to be effective would lose their effectiveness if material 417 was partially discharged before mixing with material 452 thereby upsetting the mixing ratio. Cyanoacrylate adhesives inadvertently discharged on a user's hands causes fingers to bond together and is painful and time consuming to unglue. These problems are avoided when button 457 is used on dispenser 410 while fracturing ampule 449.

After ampule 449 is broken, the external force 463 on button 57 can be removed. Spring 428 will then move stem 421 to its closed position as shown in FIG. 26. Button 457 is then removed from stem 4211 and replaced with a cap actuator 458. As shown in FIG. 21, cap actuator 458 has a elongated lateral tube 459 having a discharge orfice 460. The bottom of cap 458 has a bore 461 that telescopes over the top of stem 421. Bore 461 is open to a passage 462 that leads laterally to tube 459. Other types of cap actuators and discharge nozzles can be used with stem 421 to direct the aerosol spray to desired locations.

Figure 22:
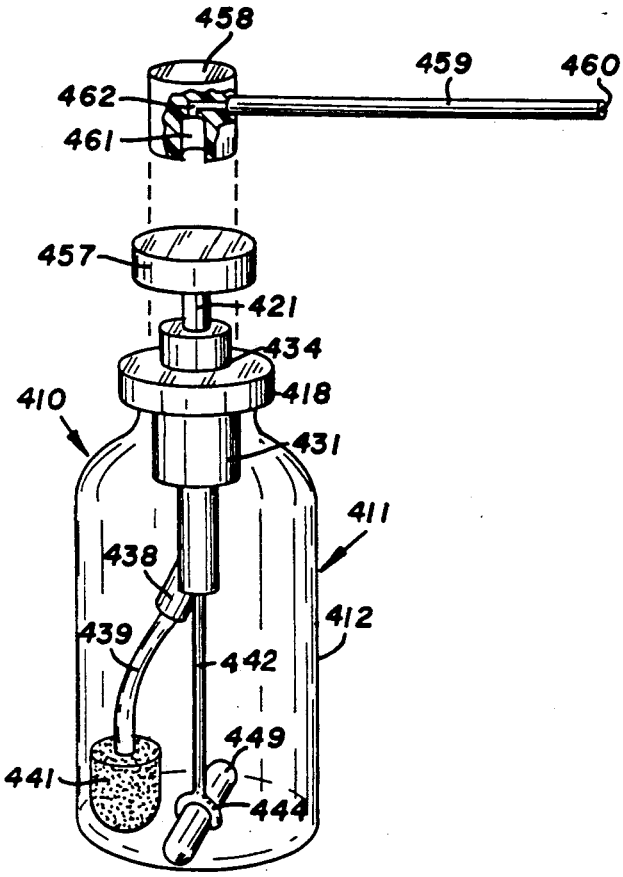
FIG. 22 is a perspective view of a fourth modification of the aerosol dispenser of the invention equipped with an actuator button and a cap with nozzle, partly sectional, having a dispensing tube for directing mixed materials to a desired location in lieu of the actuator button.
Figure 23:
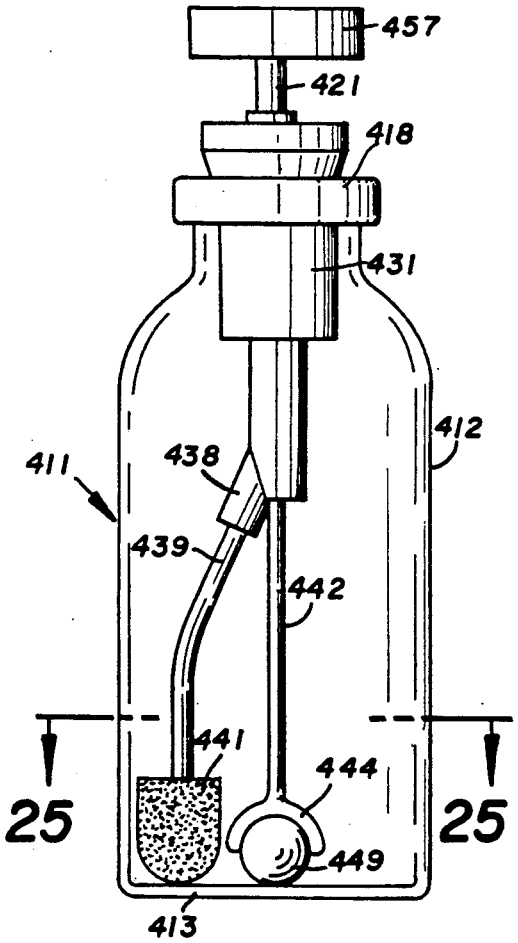
FIG. 23 is an enlarged front elevational view of the dispenser of FIG. 22.

Dispenser 410 is stored and transported in the manner shown in FIGS. 22 and 23. A cover (not shown) can be placed over button 457 and fitted on cap 418. The control valve 419 is closed thereby confining the liquid 417 and propellant to chamber 416. Ampule 449 being a hermetically sealed vessel separates and isolates the material 452 from the material from the material 417 and propellant in chamber 416. This substantially increases the shelf life of the liquids 417 and 452 and minimizes deteriation of the seal materials of the control valve 419. The separation of the first and second materials also allows the dispenser to use cyanoacrylates and two component adhesives.

The sealed ampule 449 containing liquid 452 is placed in chamber 416 through the top opening before the cap 418 is attached to rim 141. Cap 418 and control valve 419 are placed on top of container 411 as a unit. The rod 442 extends down into chamber 416 to locate foot 444 adjacent the mid-section of ampule 449. Material 417 can be placed in chamber 416 before cap 418 is placed on container 411. Propellant can be introduced into chamber 416 through stem 421 by opening valve 419.

In use the operator applies force 463 on button 457 to move stem 421 down into container 411. This moves foot 444 down into ampule 449 to break ampule 449, as shown in FIG. 27. The material 452 in ampule 449 mixes with material 417. Button 457 prevents the materials 417 and 452 from escaping through stem passage 424. Button 457 is replaced with cap actuator 458. Dispenser is now ready for use to dispense the mixed materials and propellant to a location.

The dispensers 10, 110, 210, 310 and 410 can be used to dispense two component epoxy and polyester type adhesives as a foam to a selected location, such as gaps and cracks between uneven surfaces. One component of the adhesive is stored in the bottle under pressure of the propellant. The other component of the adhesive is located within the ampule positioned within the bottle. When the ampule is broken with the push rod, the two adhesive components are mixed within the bottle. Once the components are mixed they exotherm or set up in a short period of time. The mixed adhesive components and propellant are filtered and dispensed through a tube or nozzle mounted on the valve when the valve is first opened. Manual force is used to open the valve. A cap mounted on the discharge spout of the valve prevents escape of the mixed components of the adhesive and propellant.

The adhesive is discharged from the tube or nozzle as a fozm. The foam is a mixture of the two adhesive components and the propellant gas. The foam adhesive is a light weight substance that is spreadable to increase the bond surface area of contact. The increase in surface area or wettable area and the light weight of the foam adhesive makes the foam adhesive suitable for application to overhead surfaces. The fast acting two component adhesive dispensed as a foam can be used for rapid assembly and repair applications.

While there has been shown and described of preferred embodiments of the aerosol dispenser of the invention it is understood that changes in the structures, arrangement of structures, and materials may be made by those skilled in the art without departing from the invention. The invention is defined in the following claims.

I claim:

1. A dispenser comprising: a container having an internal chamber for storing a propellant and at least one first component under pressure, normally closed valve means mounted on said container to retain the propellant and one first component under pressure in said chamber, said valve means includes a housing mounted on the container, said housing having a chamber and a hole in the bottom portion thereof, said valving means further including a valving member located in said chamber for movement in a first direction from a closed position to an open position to dispense aerosol to a desired location and in a second direction from an open position to a closed position to prevent dispensing of aerosol, frangible ampule means located within said chamber containing at least one second component that is separated from the first component within the chamber until said ampule means is broken, means for holding the ampule means in said chamber, and means connected to said valve means and connected to said means for holding the ampule means, said means connected to said valve means and connected to said means for holding the ampule means comprising a rigid push rod extended through said hole in the housing whereby when the valve means is first moved in the first direction the valve means is opened and force is transmitted through the rod and means for holding the ampule means to break the ampule means thereby releasing the second component into said internal chamber whereby the first and second components are mixed together and flow through the chamber in the housing an open means to a selected location.

2. The dispenser of claim 1 wherein: said ampule means is a generally cylindrical sealed vessel holding a chemical including said second component, said vessel having a longitudinal axis generally transverse to the longitudinal axis of said chamber.

3. The dispenser of claim 2 wherein: the means for holding the ampule means comprises a saddle shaped foot engageable with the ampule means, said foot being secured to said rod.

4. The dispenser of claim 1 including: cap means mounted on said container supporting said housing, said rod being movably mounted on said housing and connected to said moveable member, and means connected to said housing having a passage to allow the mixed components and propellant to flow into said internal chamber of the housing.

5. The dispenser of claim 4 wherein: said movable member has a recess, said rod having an end located in said recess to connect the rod to the movable member whereby said rod is moved with the body when the valve means is moved to the open position.

6. The dispenser of claim 4 wherein: the means connected to said housing includes a dip tube extended into the chamber of the container to carry propellant and mixed components to said chamber of the housing, and filter means mounted on the dip tube to prevent foreign particles from flowing into said chamber of the housing.

7. A dispenser comprising: a container having an internal chamber for storing a propellant and at least one first component under pressure, normally closed valve means mounted on said container to retain the propellant and one first component under pressure in said chamber, said valve means being moveable in a first direction from a closed position to an open position to dispense aerosol to a desired location and in a second direction from an open position to a closed position to prevent dispensing of aerosol, frangible ampule means located within said chamber containing at least one second component that is separated from the first component within the chamber until said ampule means is broken, means for holding the ampule means in said chamber, means connected to said valve means and connected to said means for holding the ampule means, said means connected to the valve means and connected to said means for holding the ampule means comprising a rigid push rod whereby when the valve means is first moved to a first direction the valve means is open and forces transmitted though the rod and means for holding the ampule means to break the ampule means thereby releasing the second component into said chamber whereby the first and second components are mixed together and flow through the open valve means to a selected location, said valve means has an outlet passage for the propellant and mixed components, and means for closing the outlet passage to prevent dispensing of aerosol during the breaking of the ampule means, said means for closing the outlet passage being removeable from the valve means after the ampule means has been broken.

8. The dispenser of claim 7 wherein: said valve means has a tubular stem containing said outlet passage, said means for closing the outlet passage comprising a button mounted on the stem for closing said outlet passage.

9. A method of dispensing a two component adhesive comprising: storing a first component of an adhesive in an enclosed container with a propellant under pressure having a valve moveable from a closed position to an open position; storing a second component of the adhesive in an ampule located within said container; breaking the ampule by moving the valve to the open position whereby the first and second components of the adhesive are mixed together; preventing the escape of the mixed components of the adhesive and propellant through the open valve during the breakng of the ampule; and discharging the mixed first and second components of the adhesive with propellant from the container by moving the valve to the open position, said adhesive being as an adhesive foam directed to a selected location.

10. The method of claim 9 wherein: the ampule is broken when the valve is first moved from the closed position to the open position.

11. The method of claim 10 including: preventing the escape of the mixed components of the adhesive and propellant when the valve is first moved from the closed position to the open position.

12. The method of claim 9 including: filtering the mixed first and second components of the adhesive before the discharge thereof from the container.

* * * * *